United States Patent [19]

Wessels et al.

[11] 4,354,929

[45] Oct. 19, 1982

[54] PROCESS FOR SEPARATING NORMAL PARAFFINS FROM HYDROCARBONS MIXTURES

[75] Inventors: Anton Wessels, Brasschaat; Andrija Fuderer, Antwerp, both of Belgium

[73] Assignee: Union Carbide Corporation, Danbury, Conn.

[21] Appl. No.: 189,351

[22] Filed: Sep. 30, 1980

[51] Int. Cl.[3] ..... C10G 25/03

[52] U.S. Cl. ..... 208/310 Z; 585/821; 585/826

[58] Field of Search ..... 208/310 Z; 585/826, 585/829, 821

[56] References Cited

U.S. PATENT DOCUMENTS 3,282,346 11/1966 Anstey et al. ..... 208/310
3,291,725 12/1966 Brodbeck ..... 208/310
3,342,726 9/1967 Mowll et al. ..... 208/310
3,422,005 1/1969 Avery ..... 208/310
4,176,053 11/1979 Holcombe ..... 208/310

*Primary Examiner*—Delbert E. Gantz
*Assistant Examiner*—William Leader
*Attorney, Agent, or Firm*—Alvin H. Fritschler

[57] ABSTRACT

Normal paraffins are separated from a gas oil-containing hydrocarbon vapor feed stream having 16 to 25 carbon atoms per molecule in a constant pressure process employing a molecular sieve adsorbent and n-hexane for purging and for dilution of gas oil-containing feedstock. Cocurrent purge effluent is used to provide a source of such n-hexane diluent, thereby reducing the equipment size and energy consumption for processing of the n-hexane purge recycle stream and increasing adsorbent utilization or the efficiency of the adsorption process.

7 Claims, 3 Drawing Figures

PROCESS FOR SEPARATING NORMAL PARAFFINS FROM HYDROCARBONS MIXTURES

BACKGROUND OF THE INVENTION

1. Field of the Invention

This invention relates to the separation of normal paraffins from non-normal hydrocarbons in hydrocarbon vapor feed mixtures. More particularly, it relates to an improved process for the separation of normal paraffins from gas oil-containing feed streams.

2. Description of the Prior Act

An isobaric process for the separation of normal paraffins from a hydrocarbon vapor feed stream having 10–25 carbon atoms per molecule and containing a mixture of said normal paraffins and non-normal hydrocarbons is disclosed in the Avery U.S. Pat. No. 3,422,005. The feed for this process may contain gas oil having 16 to 25 carbon atoms per molecule, kerosene having 10 to 15 carbons, or a mixture thereof. As disclosed in the patent, the process includes the steps of (1) adsorption, i.e., selective adsorption of normal paraffins, (2) cocurrent purge with n-hexane to sweep out void and spare vapor containing a high concentration of non-adsorbable components, i.e., non-normal hydrocarbons from the upper or effluent end of the bed, (3) countercurrent purge with n-hexane to desorb normal paraffin hydrocarbon adsorbate from the bed, the highest molecular weight, adsorbed normal hydrocarbons being concentrated near the bottom or feed inlet end of the bed. The effluent removed from the upper end of the bed is cooled and passed to a non-normal dehexanizer column from which non-normal hydrocarbons are withdrawn as a liquid bottoms product. The effluent removed from the bottom end of the bed is cooled and passed to a normal paraffin dehexanizer column from which normal paraffin bottoms are withdrawn. The n-hexane discharged as overhead from said columns is transferred to storage as liquid and is subsequently heated and used as purge fluid as indicated above. The advantages of employing n-hexane as the purge fluid and of employing a relatively high isobaric adsorption-desorption pressure level, together with a relatively low adsorption-desorption temperature range, are set forth in said Avery Patent.

It has been found that the separation process should be carried out at a temperature above the dew point of the hydrocarbon feed and sufficiently high to avoid capillary condensation. This is necessary to avoid forming a liquid meniscus in the macropores of the adsorbent pellets. If such precautions were not taken, the isomer condensate in the adsorbent macropores would not be completely removed during the copurge or displacement step, and the normal paraffin purity as well as the separation of adsorbed and unadsorbed components would be lower than in an all-vapor process. It is possible to avoid capillary condensation by ensuring that the ratio of feed saturation pressure (i.e., dew point pressure) to operating pressure is more than about 2. For this purpose, a gas oil feedstock having, for example, a dew point of 670° F. at a typical operating pressure of 25 p.s.i.a. should be contacted with a molecular sieve adsorbent at a temperature of about 730° F. At such temperature, however, excessive cracking of the gas oil vapor feed occurs, with coke formation and rapid deactivation of the adsorbent resulting therefrom. For this reason, it is preferred to operate at temperatures of between about 600° F. and 700° F. with gas oil feedstocks. In this regard, it should be noted that the cracking and deactivation rates increase with increasing molecular weights, and the problems are less serious with respect to the lighter kerosene feedstocks. A particular problem exists, however, in the processing of gas oil feedstocks so as to operate at a temperature sufficiently high to avoid capillary condensation without encountering significant cracking and deactivation problems.

Avery discloses the overcoming of this problem by the introduction of sufficient redistilled n-hexane purge gas to lower the resulting mixture's dew point and to avoid capillary condensation at the desired operating pressure, so as to permit operation at a temperature below 700° F. As the adsorbent already contains normal hexane from the previous purge step, the n-hexane introduced into the feed for dilution thereof is discharged from the bed with the unadsorbed non-normal hydrocarbons and the previously adsorbed n-hexane. This effluent is fractionated as indicated above, with the n-hexane overhead fraction being recycled for use as purge gas or for mixing with the feed material.

It has also been proposed to recycle the adsorption effluent, i.e., non-normal hydrocarbon product, to the feedstock for the desired dilution thereof. While such techniques are useful in overcoming capillary condensation while enabling temperatures below 700° F. to be employed, each is accompanied by disadvantages that limit the overall economy and effectiveness of the separation process. Thus, the use of redistilled n-hexane for feedstock dilution results in an increase in the size of the equipment employed and the amount of energy consumed in the processing of the n-hexane recycle stream, thereby increasing the cost of the overall operation. The use of the adsorption effluent for such dilution purposes tends to increase the amount of non-normals in the feed and also the amount of normal paraffins present in the product effluent, reducing the normals as well as the non-normal hydrocarbon product purity and the separate recovery of n-paraffin material. There is a need in the art, therefore, for improvements in the process for separating normal paraffins from hydrocarbon mixtures, particularly as exist in gas oil feedstocks.

It is an object of the invention to provide an improved process for the separation of normal paraffins from hydrocarbon feedstocks.

It is another object of the invention to provide an improved process for the separation of normal paraffins from gas oil feedstocks without capillary condensation effects.

It is a further object of the invention to provide a process for the effective separation of normal paraffins form gas oil feedstocks at temperatures below 700° F.

With these and other objects in mind, the invention is hereinafter described in detail, the novel features thereof being particularly pointed out in the appended claims.

SUMMARY OF THE INVENTION

The objects of the invention are accomplished by an isobaric separation process in which cocurrent purge effluent is used to provide a source of n-hexane diluent for the gas oil-containing feed. A sufficient quantity of such n-hexane diluent is employed to lower the dew point of the mixture of said gas oil-containing feed, and to avoid capillary condensation, at the desired operating pressure so that the separation of normal paraffins from the gas oil feed can be accomplished at below 700° F.

BRIEF DESCRIPTION OF THE DRAWING

The invention is hereinafter described with reference to the accompanying drawings in which.

DETAILED DESCRIPTION OF THE INVENTION

The subject invention constitutes an improved process for the separation of normal paraffins from hydrocarbon vapor mixtures present in gas oil-containing feedstocks. Gas oil may be broadly defined, for purposes of this invention, as a hydrocarbon mixture having an initial boiling point, according to the ASTM, of above 400° F. and an ASTM final boiling point below 700° F. Gas oil generally contains from about 10 to about 40 mol. percent normal paraffins having 16 to 25 carbon atoms. These normal paraffins are employed as raw materials for the synthesis of proteins, plasticizers and alcohols. It is necessary, however, to separate such normal paraffins from non-normal hydrocarbons contained in the gas oil feed material.

As noted above, the Avery patent discloses an isobaric or constant pressure process for achieving this separation, comprising: (1) adsorbing the normal paraffins on an adsorbent, (2) cocurrently purging the adsorbent bed with n-hexane to remove non-normal hydrocarbons, and (3) countercurrently purging the bed with n-hexane to desorb the normal paraffins. Additional n-hexane is employed to dilute the gas oil feed to lower the dew point of the feed mixture and to avoid capillary condensation so that the process can be carried out at less than 700° F. to avoid excessive cracking of the gas oil vapor feedstock, with resultant coke formation and rapid deactivation of the adsorbent.

The invention resides in the use of cocurrent purge effluent as a source of the n-hexane diluent. Such cocurrent purge effluent is used in place of n-hexane obtained by redistillation of the cocurrent purge effluent, of the countercurrent purge effluent or of the adsorption effluent. The size of the equipment and the amount of energy consumed for the n-hexane purge recycle stream is thereby reduced. At the same time, the adsorption efficiency, or adsorbent utilization, of the process is increased. The n-paraffin adsorption front is thus able to proceed nearer to the effluent end of the adsorbent bed without reducing the n-paraffin recovery or the purity of the non-normal hydrocarbons removed from the bed during the cocurrent purge step.

Figure 1:
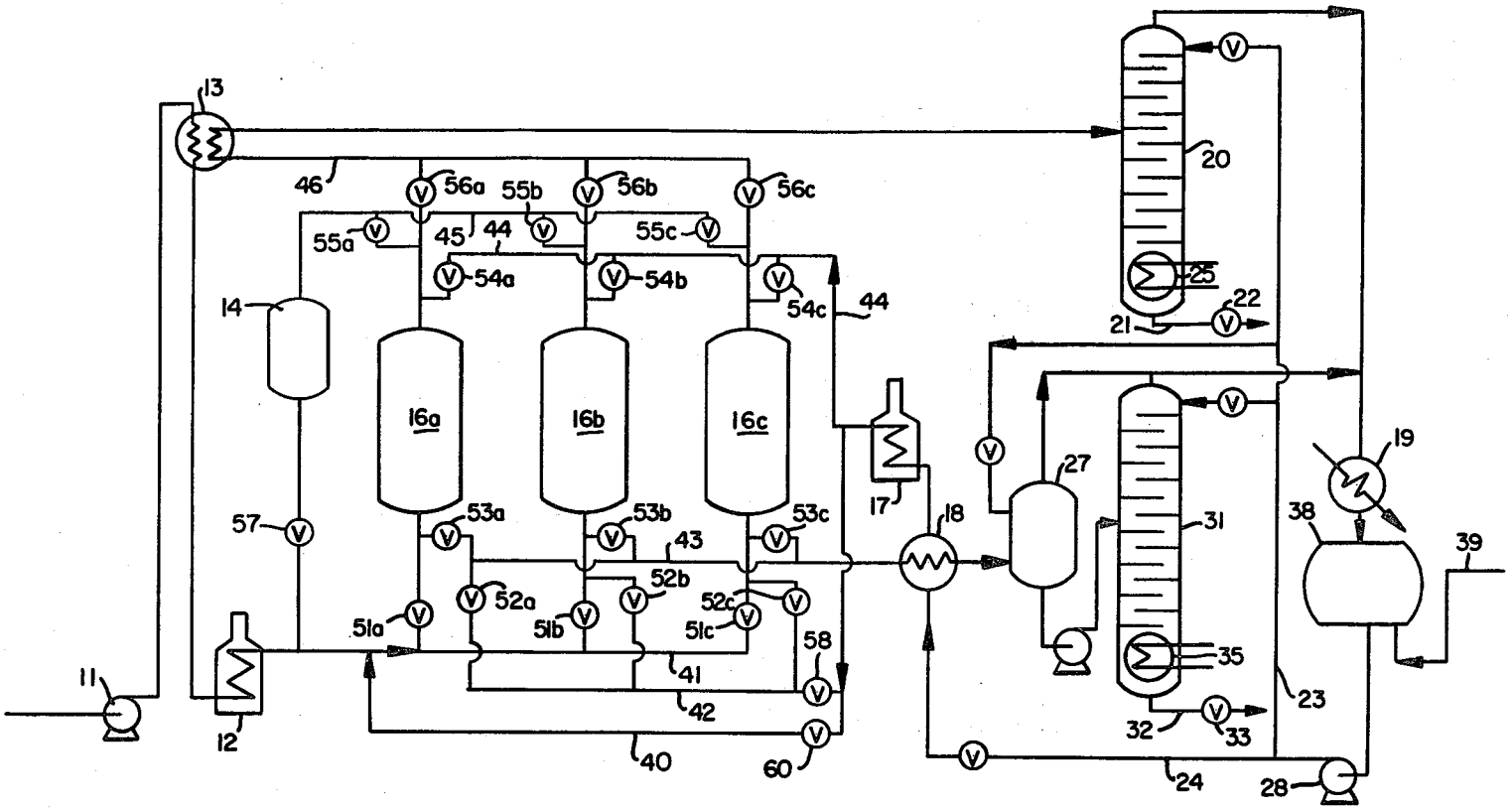
FIG. 1 is a schematic flowsheet of an illustrative embodiment utilizing three adsorbent beds operating in parallel.

Referring to FIG. 1 of the drawings, the gas oil-containing feedstock enters the illustrated process system through pump 11 at, e.g., 65 p.s.i.a., said feed being heated, e.g., to 600° F., in exchanger 13 and heater 12 from which it is passed through conduit 41 and inlet control valve 51*a* to first adsorbent bed 16*a*. The bed may typically contain calcium zeolite A in the form of 1/16 inch pellets. The feed vapor mixture is passed upwardly through said molecular sieve bed 16*a* at about 30 p.s.i.a. for adsorption of the normal paraffins therefrom. During the adsorption step, normal paraffins are selectively adsorbed, and a normal paraffin adsorption front is formed near the inlet end of bed 16*a*. As adsorption continues, this front moves upwardly from the inlet end, displacing less strongly held n-hexane purge conponent adsorbed in the previous processing cycle. A portion of the non-normal hydrocarbons not adsorbed from the feed upon passage through the bed, i.e., cyclic and branch chain hydrocarbons, are discharged through the upper end of bed 16*a* into conduit 46 as the first effluent. This effluent also contains the progressively displaced, re-adsorbed and re-displaced n-hexane purge conponent and any n-hexane used as diluent for the hydrocarbon feed. After a predetermined time that is preferably when this leading adsorption front has reached a predetermined point within bed 16*a*, as for example after about 5 minutes, the gas oil-containing hydrocarbon feed stream flow is terminated by closing inlet valve 14.

The first effluent from bed 16*a*, containing about 20% n-hexane, is passed through control valve 56*a* to joining conduit 46 from which it is passed through heat exchanger 13. To facilitate fractional condensation, the first effluent is cooled to about 380° F. therein by a coolant, such as the hydrocarbon feed. The cooled first effluent is directed to non-normals dehexanizer column 20 at about 20 p.s.i.a. In this column, the non-normal hydrocarbons are separated and withdrawn as a liquid bottons product through conduit 21 having control valve 22 therein. Dehexanizer 20 comprises a distillation column with a sufficient number of theoretical plates so that n-hexane appears in the overhead, and the bottons are free of n-hexane as needed to meet a particular non-normal hydrocarbon product specification. Dehexanizer 20 also includes a reboiler 25 at the bottom. The overhead vapor from the dehexanizer is condensed in air-cooled or water-cooled condenser 19 and is collected in storage vessel 38. From said storage vessel 38, the hexane is passed by pump 28 through conduit 23 to the dehexanizers as reflux and through conduit 24 to exchanger 18, heater 17 and conduit 44 for desorption purge.

Upon completion of the adsorption step, n-hexane purge vapor is introduced from recycle conduit 44 into conduit 42, control valves 58 and 52*a* therein and into the botton end of bed 16*a* for upward flow therethrough in the same direction, i.e., cocurrent with the previously flowing hydrocarbon vapor. This cocurrently flowing purge vapor is capable of being internally adsorbed, and effectively removes the non-internally sorbed molecules, i.e., the non-normal hydrocarbons, remaining in the bed, together with residual feed vapor remaining in the non-selective areas of the bed after adsorption. The cocurrently flowing n-hexane purge vapor is passed through first adsorption bed 16*a* at the adsorption step temperature and pressure. Such cocurrent flow is necessary to sweep out the void space vapor that contains the highest concentration of non-adsorbable components at the upper, or effluent, end of the bed.

The invention resides in the use of the cocurrent purge effluent, or a portion thereof, as a source of n-hexane for the dilution of the gas oil-containing hydrocarbon feed stream. For this purpose, all or a portion of the cocurrent purge effluent is diverted from the cocurrent purge conduit 46, via outlet control valve 55*a*, line 45, surge drum 14, and control valve 57, into feed inlet conduit 41. One advantage of recycling untreated cocurrent purge effluent to the feed for dilution purposes is that the normal paraffins desorbed by the purge do not substantially enter the first effluent but are adsorbed within the first adsorption bed. For best results, only that portion of the cocurrent purge effluent that contains substantial amounts of n-hexane purge vapor and normal paraffins should be recycled to the feed for the dilution purposes of the invention. The first portion of the cocurrent purge effluent, containing substantially only non-normal hydrocarbons, is preferably passed from first bed 16*a*, through valve 56*a* and conduit 46, to non-normals column 20 referred to above. Additional quantities of n-hexane diluent may be added to the feed material in conduit 41 from n-hexane recycle conduit 40 and control valve 60.

Upon completion of the cocurrent purge step, n-hexane purge vapor is introduced from recycle conduit 44, and control valve 54*a* therein, to the upper end of the first bed 16*a* at substantially the adsorption step temperature and pressure for countercurrent purge flow therethrough. This countercurrent purge desorbs the normal paraffin hydrocarbon adsorbate from molecular sieve bed 16*a*. The resulting mixture is discharged from the lower end through valve 53*a* and conduit 43. Countercurrent purging is used for desorption of the adsorbate because the heaviest, i.e., highest molecular weight, normal hydrocarbons are more concentrated near the feed inlet, lower end of the bed. By employing countercurrent flow, the heaviest paraffin hydrocarbons are subjected to the purging or desorbing influence of both the purge vapor itself and the lighter paraffin hydrocarbons desorbed from the upper end of the bed.

This second effluent in conduit 43, containing between 80 and 97% n-hexane, is cooled from 600° F. to about 200° F. in heat exchanger 18 by liquid n-hexane and is then directed to phase separator vessel 27. Substantially pure n-hexane vapor is passed therefrom through to condenser 19. The remaining normal paraffin-hexane mixture is directed to normals dehexanizer column 31 at about 20 p.s.i.a. The cooling and phase separation steps serve to facilitate separation of the n-hexane and normal paraffins by fractional condensation and reduce the quantity of n-hexane that must be processed in dehexanizer column 31. In this column, the vapor mixture is separated into a normal paraffin bottoms component that is withdrawn through conduit 32 having control valve 33 therein, and a n-hexane overhead component. Said normals dehexanizer column 31, which operates similarly to non-normals dehexanizer column 20, has reboiler 35 at the lower end, and an appropriate number of theoretical plates so that the n-hexane appears in the overhead, and the bottoms are free of n-hexane as needed to meet a particular normal paraffin hydrocarbon product specification.

The n-hexane overhead fraction from normals dehexanizer column 31 is also passed to condenser 19 and therefrom to storage vessel 38, along with the n-hexane overhead liquid fraction from non-normals dehexanizer column 20. The reflux hexane is pumped to the dehexanizers by pump 28 through line 23.

Any makeup n-hexane that may be needed for the process may be introduced to storage vessel 38 from an external source through conduit 39. The n-hexane required for purging can be withdrawn from vessel 38 also by pump 28. Such n-hexane is warmed and vaporized in heat exchanger 18, and, in heater 17, it is heated to the adsorption step temperature, e.g. 640° F. The resulting hot n-hexane vapor is then passed through conduits 43 and 42 and control valves 58 and 52*a*, during the appropriate period, as the cocurrently flowing purge vapor entering first molecular sieve adsorption bed 16*a* immediately following the adsorption step. The larger portion of the hot n-hexane vapor discharged from heater 17 is directed through conduit 44 and control valve 54*a*, during the appropriate period, for countercurrent purging of first bed 16*a*, thereby desorbing the normal paraffin adsorbate as previously described.

Although the process has been specifically described in terms of sequential adsorption, cocurrent purge and countercurrent desorption of first bed 16*a*, it will be apparent to those skilled in the art that second and third beds 16*b* and 16*c* may also be filled with a molecular sieve adsorbent, e.g., with calcium zeolite A pellets, and piped in parallel flow relation with said first bed 16*a*. Such an arrangement in which more than one adsorbent bed is employed is preferred since most commercial operations require continuous production, and the normal paraffin and non-normal hydrocarbon products can only be produced intermittently with a one adsorbent chamber system. For this reason, at least three adsorbent beds are usually employed so that, while on bed is on the adsorption step, another bed is being copurged and a third bed is being used for countercurrent desorption. This permits continuous production of both n-paraffins and non-normal hydrocarbons by means of the three step process. The flows between first, second and third adsorbent chambers are switched at the appropriate times in a manner well known to those skilled in the art. It should be noted on the drawing that the second and third adsorption beds are accompanied by conduits and control valves, such as 52*b*, 52*c*, 53*b*, 53*c*, 54*b*, 54*c*, 55*b*, 55*c*, corresponding to those described with reference to first bed 16*a*.

It will be appreciated that various changes and modifications can be made in the process described above without departing from the scope of the invention claimed herein. Thus, the adsorption-purge-desorption steps can be carried out at temperatures of from about 500° F. to 700° F., preferably at a temperature within the range of from 600° F. to said 700° F. As disclosed by the Avery patent, the purge and desorption step temperatures and pressures are desirably the same as those employed in the adsorption step. Such processing steps are carried out in an essentially constant pressure process, employing a relatively high, superatmospheric pressure in the range of from about 15 to about 65 p.s.i.a. It should also be noted that the gas oil-containing feedstocks treated in accordance with the present invention may also include mixtures of such gas oil with kerosene. Such kerosene may be broadly defined as a hydrocarbon mixture having an initial boiling point, according to the American Society of Testing Materials (ASTM) of about 275° F. and an ASTM final boiling point below 600° F. Kerosene contains between about 10 and 40 mol. percent normal paraffins having 10 to 15 carbon atoms per molecule.

Various other aspects of the subject adsorption-purge-desorption process for separating normal paraffins from hydrocarbon mixtures are described in the Avery patent referred to above and incorporated herein by reference. Such aspects, including the molecular sieve adsorbents suitable for use in the process and information concerning the relation between dew point and capillary condensation points for a particular gas oil at various operating pressures, and the means for determining the percentage dilution of the gas oil feed with normal hexane or other diluents, need not be repeated herein. In the practice of the invention, of course, the gas oil-containing feed is diluted with copurge effluent, as a source of n-hexane, to permit operation of the process at a temperature below 700° F.

It is within the scope of the invention, as indicated above, to recycle the entire copurge effluent for dilution of the feed or to recycle only the portion of said effluent that contains appreciable quantities of n-hexane. In generally preferred embodiments of the invention, initial cocurrent purge effluent is not recycled as it contains mostly non-normal hydrocarbons, i.e., isomers, including sulfur compounds, while the latter portion contains mostly hexane with increasing quantities of normal paraffins. Thus, the last 10 to 80% of the copurge effluent is preferably recycled for dilution purposes.

Figure 2:
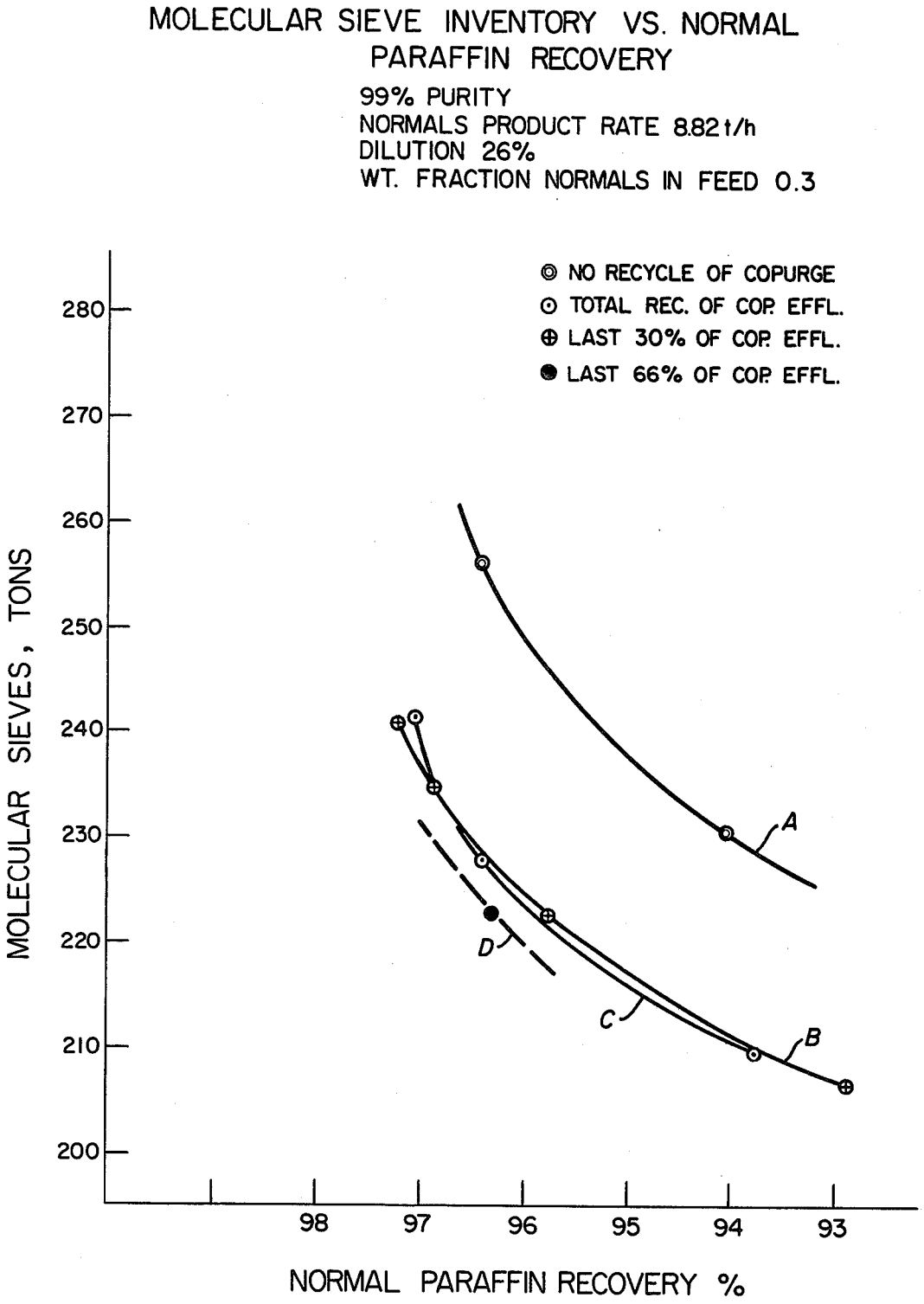
FIG. 2 is a plot of sieve inventory vs product recovery with and without the practice of the invention.

In illustrative comparative runs demonstrating the advantages of the invention, a gas oil feed having an average molecular weight of 210, with a weight fraction of 0.3 normal paraffins, is processed at 640° F. and a pressure of 30 psia. A low operating temperature, requiring the relatively high dilution of 26 weight % of the overall diluted feed, is employed as it results in only a moderate deactivation rate for the calcium zeolite A adsorbent despite the high sulfur content of the feed. FIG. 2 illustrate the total inventory of molecular sieves found to be necessary to produce 8.82 tons/hr. of normal paraffins at 99% purity at various recoveries under the above indicated conditions. To obtain a normal paraffins recovery of 96%, for example, the following amounts of molecular sieves inventory are required:

| | |
|---|---|
| With no recycle (Curve A) | 249 tons |
| With last 30% copurge recycled (Curve B) | 224 tons |
| With last 60% copurge recycled (Curve D) | 220 tons |
| With 100% copurge recycled (Curve C) | 223 tons |

From these results, it is apparent that, by recycling from about 30% to 100%, preferably about 30–80%, of the copurge effluent for feed dilution purposes, the molecular sieve inventory can be reduced by about 10% at a given normal paraffin recovery.

Figure 3:
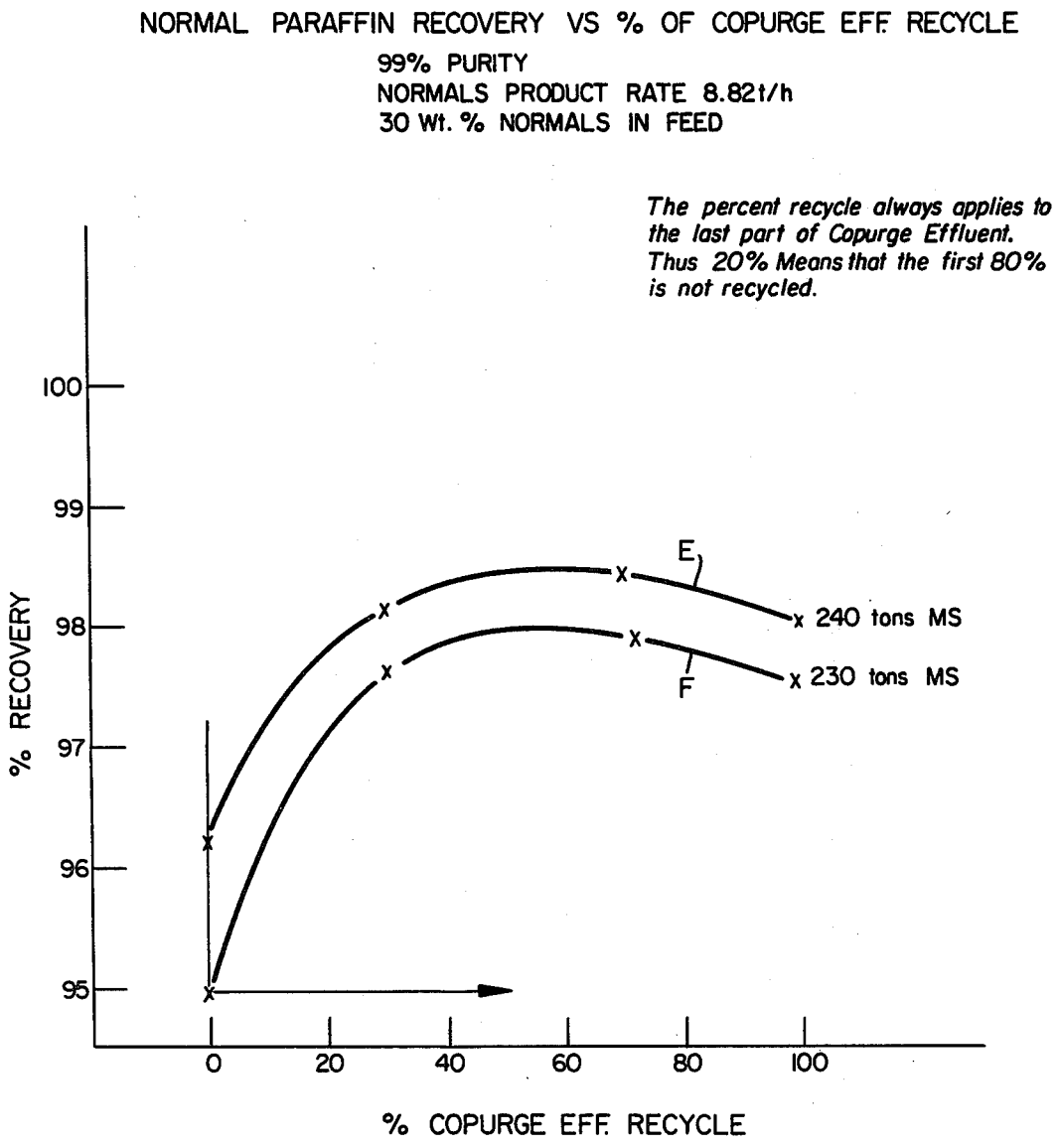
FIG. 3 is a plot of product recovery vs the % of copurge effluent recycled in accordance with the invention.

The change in recovery with varying copurge recycle rates for feed dilution, at the same conditions as apply for the FIG. 2 embodiments, is illustrated in FIG. 3. For example, curve E of FIG. 3, based on a total molecular sieve inventory of 240 tons, indicates that the optimum recovery of normal paraffins is obtained when the last about 30% to 100%, preferably about 30–80%, of the copurge is recycled for dilution purposes with a peak at about 60% recycle. When no recycle is applied, the recovery drops from above 98% to approximately 96.3%. A similar result is shown in curve F at a total molecular sieve inventory of 230 tons, with the last about 30% to 100% of the copurge being recycled to achieve normal paraffins recovery. A peak is obtained at about 55%, with the recovery dropping from a peak of 98% to 95% when no recycle of copurge effluent is employed.

Such comparative runs illustrate the advantages obtained by use of the copurge effluent for dilution of gas oil containing feedstocks. From such comparative runs, it can be observed that, at equal product purity, total hexane, product flow and molecular sieve inventory, the invention enables product recovery to be increased, or feed flow reduced, by between 0.6 and 1.5% when the specific normal paraffins purity is 98%. At a 99% purity level, such recovery is increased by between 1.2 and 3%. Alternatively, at equal product purity, recovery, total hexane and product flow, the invention enables the molecular sieve adsorbent inventory to be reduced by about 6% for a normal paraffins purity of 98%. At a 99% purity level, such adsorbent inventory is reduced by about 10%.

Those skilled in the art will readily appreciate that any desired temperature in the indicated ranges up to 700° F. can be used in the subject isobaric adsorption-copurge-desorption process for normal paraffin recovery from gas oil feeds. Such temperature will determine the amount of dilution employed at a desired operating pressure. From such factors and the desired purity of the product, feed stream characteristics, adsorbent performance capability and the like, those skilled in the art can readily determine whether all or a portion of the copurge effluent should be employed in any given application to enable the gas oil feed to be processed at a temperature below 700° F. while avoiding capillary condensation effects.

It should be noted that the recycle of copurge effluent for feed dilution can also be employed with kerosene feed streams although such recycle does not offer the desirable advantages that pertain for gas oil feedstreams. With kerosene, the recycle of the entire copurge effluent does not appear to offer any advantage. Recycle of the last portion, e.g. 50%, of the copurge effluent to a kerosene feed may allow a reduction of about 2–4% in bed size at a given product recovery. The advantage of higher bed utilization is largely compensated by the dilution of feed with hexane, which is not necessary to avoid capillary condensation in the case of kerosene as it is for gas-oil containing feedstocks.

The invention provides a valuable improvement in the constant pressure process for separating normal paraffins from hydrocarbon mixtures. The invention enables gas oil-containing feedstocks to be treated for said separation of normal paraffins at temperatures below 700° F., thus avoiding capillary condensation, while achieving desirable optimization of the process. Thus, the equipment size and the energy consumption required for redistillation of n-hexane for purging and dilution purposes can be significantly reduced by recycle of the copurge effluent, or a portion thereof, to the feed for dilution purposes. Moreover, the utilization of the molecular sieve adsorbent and the efficiency of the adsorption operation can be enhanced, with desirable economics being compatible with useful processing flexibility. The improvement in the overall separation process obtainable in the practice of the invention can thus be used in a manner accommodating the needs of a particular application, while enhancing the overall technical-economic feasibility of the separation process, particularly in the treatment of gas oil-containing feedstocks.

What is claimed is:

1. In an isobaric process for separating normal paraffins from non-normal hydrocarbons in a gas oil-containing vapor feedstream by (1) the selective adsorption of normal paraffins by passage of said feedstream through a molecular sieve adsorbent bed, (2) cocurrent purge with n-hexane to sweep out void space vapor containing a high concentration of non-normal hydrocarbons from the effluent end of the bed, (3) countercurrent purge with n-hexane to desorb normal paraffin adsorbate from the bed, (4) recovery of n-hexane from said separated normal paraffins and non-normal hydrocarbons, and (5) recycling of said n-hexane for purging and desorbing of said bed and to dilute the gas oil-containing feedstream for adsorption at less than 700° F., the improvement comprising diluting said gas oil-containing feedstream with cocurrent purge effluent as a source of n-hexane used to enable said selective adsorption to be carried out at less than 700° F. without capillary condensation, wherein the initial portion of the cocurrent purge effluent containing essentially non-normal hydrocarbon is not employed for said feedstock dilution, and the remaining portion of said cocurrent purge effluent comprising about the last 10% to 80% of the total cocurrent purge effluent is used as a source of n-hexane for said feedstream dilution purposes, whereby the equipment size and energy consumption for processing of said recycle n-hexane are reduced and the utilization of said adsorbent and the efficiency of the adsorption process can be enhanced.

2. The process of claim 1 in which about the last 30% to 80% of the total cocurrent purge effluent is used for feedstream dilution purposes.

3. The process of claim 1 in which said isobaric pressure is in the range of from about 20 to about 65 p.s.i.a., said adsorption being carried out at a temperature of from about 500° to 700° F., said cocurrent purge and said countercurrent purge being carried out at the adsorption temperature.

4. The process of claim 3 in which said adsorption temperature is from about 600° F. to 700° F.

5. The process of claim 1 in which said gas oil-containing feedstream comprises a mixture of gas oil and kerosene.

6. The process of claim 1 in which the gas oil-containing feedstream is treated in at least two molecular sieve adsorbent beds, with said feedstream being introduced into at least one bed continuously so that intermittent production is avoided.

7. The process of claim 6 in which said feedstock is treated in at least three beds, with one bed undergoing adsorption while the second bed is undergoing cocurrent purge and the third bed is undergoing countercurrent purge.

* * * * *